US010538417B1

(12) United States Patent
Raman et al.

(10) Patent No.: US 10,538,417 B1
(45) Date of Patent: Jan. 21, 2020

(54) CONSTRUCTION BEAM ROBOT

(71) Applicant: RevolutioNice Inc., Belleville, NJ (US)

(72) Inventors: Sreenivas Raman, Park Ridge, NJ (US); Elie Cherbaka, Franklin Lakes, NJ (US); Ryan J. Giovacchini, Hamilton, NJ (US); Brian Jennings, Paramus, NJ (US); Thomas C. Slater, New York, NY (US)

(73) Assignee: RevolutioNice Inc., Belleville, NJ (US)

( * ) Notice: Subject to any disclaimer, the term of this patent is extended or adjusted under 35 U.S.C. 154(b) by 55 days.

(21) Appl. No.: 15/203,792

(22) Filed: Jul. 6, 2016

Related U.S. Application Data

(60) Provisional application No. 62/189,199, filed on Jul. 6, 2015.

(51) Int. Cl.
*B66C 13/08* (2006.01)
*B66C 13/06* (2006.01)

(52) U.S. Cl.
CPC ..... *B66C 13/08* (2013.01); *B66C 13/06* (2013.01); *B66C 2700/0371* (2013.01)

(58) Field of Classification Search
CPC ..... B66C 13/00; B66C 13/04; B66C 13/08; B66C 13/085
USPC ..... 212/272
See application file for complete search history.

(56) References Cited

U.S. PATENT DOCUMENTS 3,799,358 A * 3/1974 Putnam ..... B66C 13/08 212/242
2004/0032140 A1* 2/2004 Solstad ..... B66C 1/06 294/82.15

FOREIGN PATENT DOCUMENTS

DE 3517777 A1 * 1/1986 ..... B66C 13/08
GB 2544513 * 5/2017 ..... B66C 13/08
JP 09309687 A * 12/1997 ..... B66C 13/08

* cited by examiner

*Primary Examiner* — Michael R Mansen
*Assistant Examiner* — Juan J Campos, Jr.
(74) *Attorney, Agent, or Firm* — Brient IP Law, LLC

(57) ABSTRACT

A construction beam robot, such as for steel erection, comprises a pair of thrust producing fans located at either end of a beam to be installed. The fans' thrust and direction of thrust is controlled and/or coordinated by a computer with custom control software. By altering the direction and amount of thrust, the orientation of the beam is controlled. Workers on site who possess a controller are able to rotate or fix the orientation of a beam from a distance and do so wirelessly.

12 Claims, 2 Drawing Sheets

| | |
|---|---|
| 1 | Positioning Fan |
| 2 | Cable Attachment |
| 3 | Beam Latch |

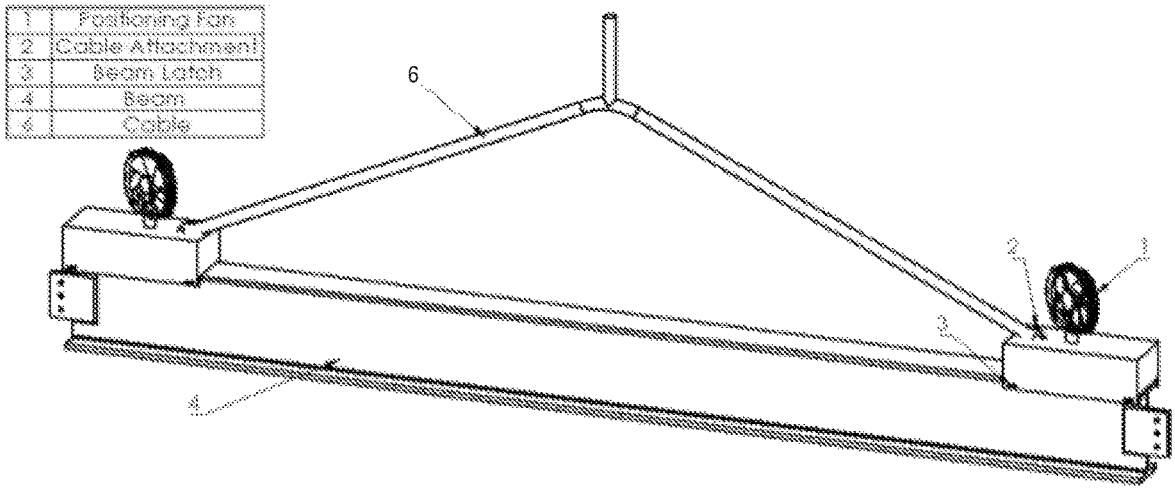
Fig. 2
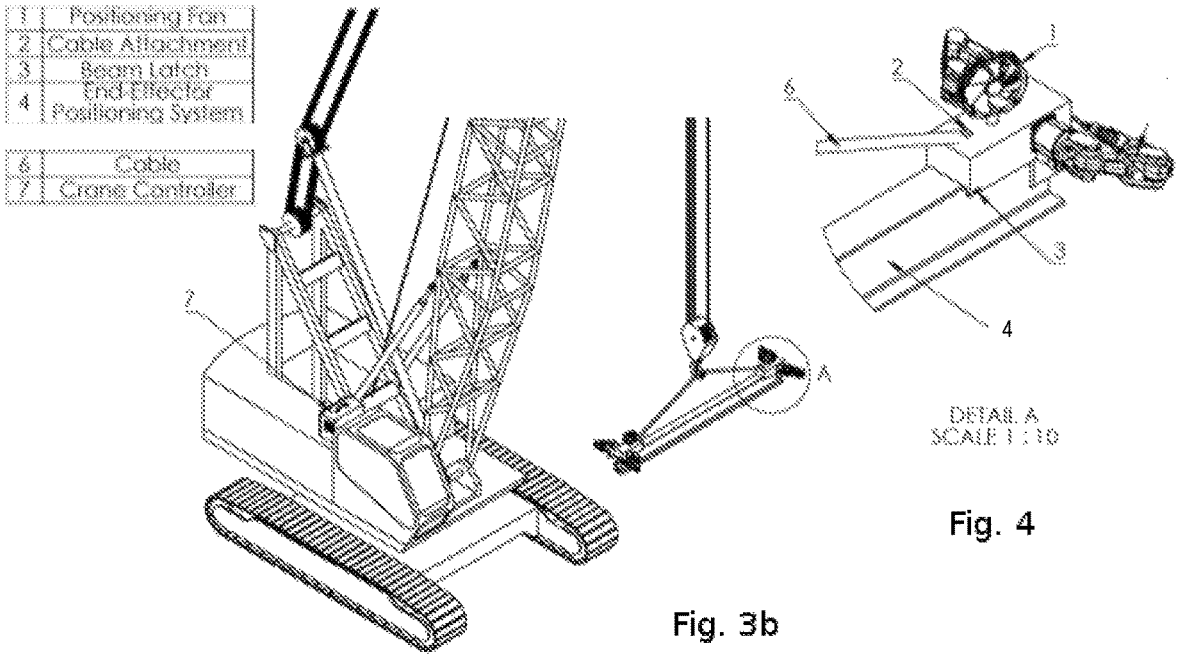
Fig. 4
Fig. 3b
Fig.3a

CONSTRUCTION BEAM ROBOT

CROSS-REFERENCES TO RELATED APPLICATIONS

This application claims the benefit of United States Provisional Application For Patent, Ser. No. 62/189,199, filed Jul. 6, 2015 and whose contents are incorporated by reference herein in their entirety.

FIELD OF THE INVENTION

Embodiments of the present invention include construction systems, and more specifically, automated systems for steel erection.

BACKGROUND OF THE INVENTION

During the construction of steel frame buildings, large steel beams are lifted to great heights, positioned so that the brackets on their ends line up with the brackets on previously erected beams, and then connected with either bolts or welds. The beams are lifted by crane, and when in the of their final position, the beams are guided by attached ropes that are held by workers on the ground. When within an arm's length of their final position, steelworkers located on nearby beams guide the beams by hand so that their brackets align correctly and begin to join the beams. This work is very dangerous and requires excellent coordination between crane operators, workers on the ground, and workers precariously positioned on the nearby steel beams.

It would be advantageous to have a system that would allow for rotation of the beam to be controlled while it is suspended from the crane. The system should also be able to move the beam short distances in any direction on the horizontal plane. In one embodiment of the invention, the device should interface with the crane control system to direct the operation of the crane as well. This system would reduce the need for workers on the ground to guide the beam with ropes and would be an integral component of a forthcoming automated beam joining system.

BRIEF SUMMARY OF THE INVENTION

An object of the present invention is a robot for construction.

Another object of the present invention is a robot for steel erection.

And another object of the present invention is a robot which can do steel erection under remote control.

Yet another object of the present invention is a robot which can do steel erection in a dynamic environment.

Still another object of the present invention is a steel erection robot which is mobile.

In an embodiment of the present invention, when heavy beams, such as steel beams, are lifted by crane, the center of gravity of the beam is inline with the lifting cable. While this prevents one end of the beam from sinking lower than the other, it does not prevent rotation about the vertical axis (yaw).

The invention comprises a pair of thrust producing fans located at either end of the beam. Their thrust and direction of thrust is controlled and/or coordinated by a computer with custom control software. By altering the direction and amount of thrust, the orientation of the beam is controlled and the time and number of workers needed to place the beam is reduced. Workers on site who possess a controller are able to rotate or fix the orientation of a beam from a distance and do so wirelessly.

Additionally, the final beam position is often not visible by the crane operator who must rely on instructions radioed to him by workers near the beam. This makes for slow positioning and increases the likelihood of a beam colliding with something.

In one embodiment of the invention, the proposed device also integrates with the crane controls to facilitate a coordinated lift and positioning of the beam. The wireless controller control crane functions. Alternatively, the control software determines crane movement paths and simultaneously changes the beam rotation or yaw angle.

The invention also uses sensor inputs and Building Information Modeling ("BIM") data to avoid obstacles as it is moved to its final position.

BRIEF DESCRIPTION OF THE SEVERAL VIEWS OF THE DRAWING

FIG. 2 shows a beam upon which is mounted two fan units as shown in FIG. 1.

FIG. 3*a* shows a crane as used in the invention.

FIG. 3B shows the beam as shown in FIG. 2 supported by the crane as shown in FIG. 3*a*.

FIG. 4 shows a detail of the end of the beam in FIG. 3B, within circle "A".

DESCRIPTION OF THE INVENTION

Figure 1:
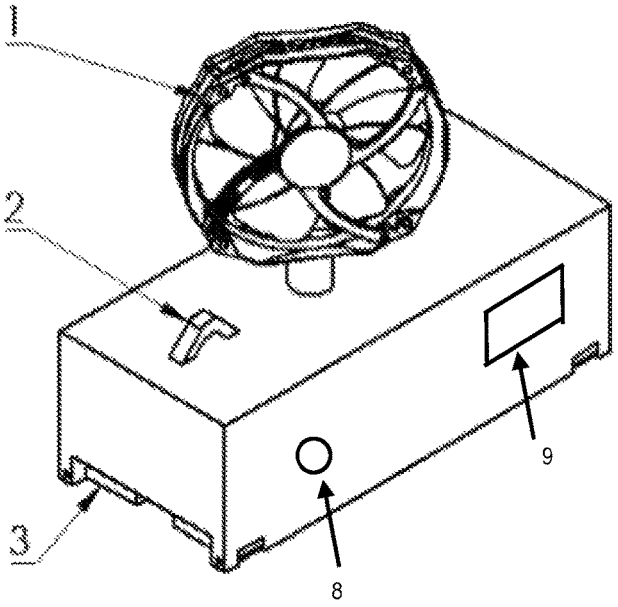
FIG. 1 shows a perspective view of an embodiment of a fan unit of the invention.

Although the preferred material for use in construction with the invention is steel beams, one may also use beams made of other materials and other construction objects that are placeable by a crane.

The invention comprises two fan units that are positioned near the opposite ends of the beams 4 before it is hoisted by the crane. In one embodiment of the the invention, the units themselves function to grasp the beam and provide an attachment point for the crane cables. In another embodiment of the invention, the fan units are independent of any lifting hardware and are affixed to the beam by any number of means. In either of the previous embodiments, the fan units may be connected by a rigid member and function simultaneously as a spreader bar. Using spreader bars is well known in the relevant art.

Each fan unit comprises a fan 1, a mechanism that is capable of rotating the fan through 360 degrees, and a communications unit. In various embodiments of the invention, the power supply (e.g. a battery) may be located in the fan unit or power may be supplied by a cable that is connected to some other external source of energy. The positioning fans will be have wireless communications capabilities both to communicate between themselves and as well as with controller that may be located elsewhere on the construction site.

In one embodiment of the invention, the fans 1 will respond to operator input and rotate and provide thrust as necessary to rotate the beam 4 as directed by the operator.

In another embodiment, the operator specifies a particular orientation for the beam and the fans act to ensure that the beam maintains orientation throughout the lifting and positioning process. In this case, the fans will rely on control software with negative feedback to adjust for any external interferences, such as, wind or the rotation of the crane cable.

In its various embodiments, the control software and positioning fans 1 make use of integrated or external sensors to dynamically position the beam 4.

To determine and monitor the orientation of the beam 4, laser trackers 8 that constantly observe and record the distance of the fan units are preferably employed in certain embodiments. Alternatively, the system uses other technologies well known in the relevant art to track the orientation of beam, such as, a local positioning system that uses radio frequencies such as wireless ("wifi").

The fans 1 are able move the beam 4 throughout the positioning process to avoid obstacles. In one embodiment of the invention, the controller 9 interfaces with the crane controls 7 to coordinate crane actions and fan positioning actions. The controller makes use of user inputs, sensor data, and/or BIM data to determine an optimal movement path for the beam. The controller then operates the crane as needed to position the beam in space while the fans control the rotation or yaw in order to arrive at the final intended pose. Appropriate controller algorithms are well known in the relevant art.

In one embodiment of the invention, the fan units grasp the beams using a beam latch mechanism 3 and function as the attachment point 2 for the crane cables 6. The mechanism to grasp the beam is adjustable, allowing for different size beams to be securely held. This gripping mechanism is preferably electromechanic in nature and allows for the fan units to detach themselves from the beam once the beam has been fixed in its final position. This kind of mechanism is well known in the relevant art.

In various embodiments, the fan units are connected by a rigid bar to allow the units to function as a spreader bar. In one embodiment of the invention, the bar is removable or its length adjustable. In its various embodiments, the fan units move along the the length of the beam.

In other embodiments of the invention, the fans are attached to the beam by means that need not be capable of supporting the entire weight of the beam as the crane cables will be attached separately. The fan units are preferably affixed to the beam with an integrated magnet. Alternatively, the fan units are affixed with a strap or some other means. The fans themselves are enclosed in a cage to prevent injury from contact with the spinning blades.

In various embodiments of the invention, the fan motors are reversible and able to reverse direction of thrust solely by switching direction of rotation.

The system is capable of moving the beam in one direction or another for limited distances as well. When directed by control software or a human operator, the fans both push in the same direction and move the entire beam if necessary, while maintaining its rotational orientation around the vertical axis (yaw angle). The amount of movement in this manner is limited only by the length of the crane cable, the weight of the beam, and the power of the fans.

In use, the invention is employed as described above.

Although this invention has been described with a certain degree of particularity, it is to be understood that the present disclosure has been made only by way of illustration and that numerous changes in the details of construction and arrangement of parts may be resorted to without departing from the spirit and scope of the invention.

What is claimed is:

1. A construction robot for positioning a beam using a crane comprising:

a first fan unit comprising:

a first fan;

a first cable attachment mechanism; and a first beam latch mechanism;

a second fan unit comprising:

a second fan;

a second cable attachment mechanism; and a second beam latch mechanism; and a controller operationally connected to the first fan and the second fan, wherein:

the first cable attachment mechanism is configured to serve as an attachment point for a first portion of a crane cable;

the second cable attachment mechanism is configured to serve as an attachment point for a second portion of the crane cable;

the first beam latch mechanism is configured to grasp a first portion of the beam adjacent a first end of the beam;

the second beam latch mechanism is configured to grasp a second portion of the beam adjacent a second end of the beam that is spaced apart from the first end of the beam; and the controller is configured to operate the first fan and the second fan to adjust an orientation of the beam while the crane is lifting the beam via the crane cable.

2. The construction robot of claim 1, further comprising a rigid member, wherein:

the first fan unit is disposed adjacent a first end of the rigid member; and the second fan unit is disposed adjacent a second end of the rigid member.

3. The construction robot of claim 1, wherein the first fan unit is configured to provide a first attachment point to the beam for the crane cable; and the second fan unit is configured to provide a second attachment point to the beam for the crane cable.

4. The construction robot of claim 1, wherein the first beam latch mechanism and the second beam latch mechanism are adjustable to enable the construction robot to grasp beams of varying sizes.

5. The construction robot of claim 1, wherein the first beam latch mechanism is electro-mechanic.

6. The construction robot of claim 1, further comprising one or more laser trackers configured to track the orientation of the beam.

7. A construction robot comprising:

a first fan having a first thrust and comprising a first beam latch mechanism configured to grasp a first portion of a beam adjacent a first end of the beam;

a second fan having a second thrust and having a second beam latch mechanism configured to grasp a second portion of the beam adjacent a second end of the beam;

a crane from which to suspend the beam, the crane comprising at least one crane cable that includes a first crane cable end and a second crane cable end; and a controller operationally connected to the fans, wherein:

the first fan provides a first attachment point for the first crane cable end;

the second fan provides a second attachment point for the second crane cable end;

the controller is configured to operate the first fan and the second fan to adjust an orientation of the beam while the crane is lifting the beam via the at least one crane cable; and the construction robot is configured to:

grasp the first end of the beam using the first beam latch mechanism;

grasp the second end of the beam using the second beam latch mechanism;

use the crane to lift the beam from an initial position to a final beam position; and operate the first fan and the second fan to maintain the beam in a desired orientation as the crane lifts the beam from the initial position to the final beam position.

8. A construction robot as described in claim 7, wherein the controller is able to control the first and second thrusts.

9. A construction robot as described in claim 8, further comprising a crane controller operationally connected to the crane.

10. A construction beam positioning system comprising:

a crane;

a crane cable;

a first fan unit comprising:

a first fan;

a first cable attachment mechanism attached to the crane cable; and a first beam latch mechanism;

a second fan unit comprising:

a second fan;

a second cable attachment mechanism attached to the crane cable; and a second beam latch mechanism; and a controller configured to control operation of the first fan and the second fan, wherein the construction beam positioning system is configured to lift a beam from an initial position to a final beam position by:

grasping a first end of the beam using the first beam latch mechanism;

grasping a second end of the beam using the second beam latch mechanism;

using the crane to lift the beam from the initial position to the final beam position via the crane cable; and while the crane is lifting the beam from the initial position to the final beam position via the crane cable, using the controller to cause the first fan and the second fan to produce thrust to maintain the beam in a desired orientation.

11. The construction robot of claim 10, further comprising one or more laser trackers configured to track the orientation of the beam.

12. The construction robot of claim 10, wherein the controller is further configured to:

receive orientation data from the one or more laser trackers; and operate the first fan and the second fan based on the orientation data to maintain the beam in the desired orientation.

* * * * *